United States Patent [19]

Schulte et al.

[11] Patent Number: 4,790,772

[45] Date of Patent: Dec. 13, 1988

[54] ELECTRIC CONNECTING TERMINAL

[75] Inventors: Siegfried Schulte; Manfred Böing; Friedrich W. Otlinghaus, all of Lüdenscheid, Fed. Rep. of Germany

[73] Assignee: Schulte-Elektrotechnik GmbH & Co. KG, Lüdenscheid, Fed. Rep. of Germany

[21] Appl. No.: 137,513

[22] Filed: Dec. 23, 1987

[30] Foreign Application Priority Data

Jan. 8, 1987 [DE] Fed. Rep. of Germany ..... 3700318

[51] Int. Cl.[4] ..... H01R 4/24

[52] U.S. Cl. ..... 439/439; 439/860; 439/575

[58] Field of Search ..... 439/816, 868, 862, 860, 439/859, 853, 852, 856, 821, 709, 720, 813, 815, 542, 543, 550, 552, 553, 564, 575, 359, 364, 436–441

[56] References Cited

U.S. PATENT DOCUMENTS

| | | | |
|---|---|---|---|
| 1,213,632 | 1/1917 | Hammond | 439/860 |
| 1,909,306 | 5/1933 | Nowosielski | 439/859 |
| 2,049,130 | 7/1936 | Miron | 439/859 |
| 2,708,266 | 5/1955 | Pavlinetz | 439/550 |
| 3,728,669 | 4/1973 | Churla | 439/860 |

*Primary Examiner*—David Pirlot

*Attorney, Agent, or Firm*—Peter K. Kontler

[57] ABSTRACT

A substantially U-shaped electric connecting terminal wherein a plate-like web is flanked by and is integral with two sidewalls. The web has a centrally located partly circular opening and two sector-shaped springy lugs which extend into the opening. Each sidewall has an outer panel which is integral with the web and an inner panel which is integral with the respective outer panel and carries a springy lug which overlies a portion of the opening. The dimensions of the lugs are selected in such a way that, when the web is impaled on a cylindrical or polygonal stud of a support for the terminal, the tips of the lugs frictionally engage the peripheral surface of the stud and hold the terminal in a selected position with reference to the support. The lugs of the sidewalls alternate with the lugs of the web and define therewith slots which extend radially of the opening.

10 Claims, 1 Drawing Sheet

ELECTRIC CONNECTING TERMINAL

BACKGROUND OF THE INVENTION

The invention relates to terminals for use in electric circuits, and more particularly to improvements in so-called connecting terminals of the type capable of being connected to a plurality of electric conductors. Still more particularly, the invention relates to improvements in connecting terminals of the type wherein a body of metallic sheet material is designed to be mounted on a protuberance and, to this end, portion of the terminal is provided with an opening for an anchoring stud or the like.

It is known to make a connecting terminal from a sheet metal blank and to thereupon mount the terminal on a plate-like or otherwise configurated support by means of one or more screws, bolts, elastic clamps, split rings or otherwise configurated fasteners. The dimensions of the terminals are selected with a view to conform to the dimensions of the parts (for example, plugs) which are to be used therewith. A drawback of such terminals is that the fasteners which are used to secure them to selected supports are separately produced parts so that the attachment of terminals to their supports takes up a certain amount of time and necessitates the application of tools. Moreover, the force with which the terminals are affixed to and held on their supports cannot be determined with a requisite degree of accuracy and reproducibility.

OBJECTS AND SUMMARY OF THE INVENTION

An object of the invention is to provide a novel and improved connecting terminal which need not be affixed to its support by one or more specially and separately produced parts.

Another object of the invention is to provide a novel and improved blank which can be converted into the above outlined terminal.

A further object of the invention is to provide a terminal which can be secured to its support with a force that ensures reliable retention of the terminal in an optimum position.

An additional object of the invention is to provide a terminal which embodies built-in fastener means.

Still another object of the invention is to provide a simple and inexpensive terminal which can be produced in any one of a wide variety of different sizes and/or shapes.

A further object of the invention is to provide a simple and inexpensive but strong and rugged terminal which can stand pronounced deforming forces.

Another object of the invention is to provide a terminal which can be affixed to its support with little loss in time and with the exertion of a relatively small force.

The invention is embodied in an electrical connecting terminal which can be impaled on a protuberance (such as a cylindrical or polygonal stud) of a support (the support can resemble a U-shaped housing with a channel for reception of a portion of the terminal). The terminal comprises a preferably plate-like web having a stud-receiving opening and at least one first stud-engaging projection which extends into the opening, and at least one sidewall which is integral with the web and has a springy second stud-engaging projection which overlies a portion of the opening. The web and the at least one sidewall together form a substantially L-shaped body.

In accordance with a presently preferred embodiment, the terminal further comprises a second sidewall which is integral with the web and has a springy third stud-engaging projection which overlies the opening. The web and the two sidewalls together form a substantially U-shaped body wherein the web is located between the two sidewalls.

The web can be provided with two first projections, and such projections then alternate with the projections of the sidewalls.

Each sidewall preferably comprises an outer panel which is integral with the web and an inner panel which is integral with the respective outer panel. The second and third projections are integral with and extend substantially at right angles to the respective inner panels. The opening can constitute a part of a substantially circular opening, and each projection can constitute or include a substantially sector-shaped lug extending along an arc of approximately 90 degrees in the circumferential direction of the opening. Each of the second and third projections preferably defines with the first projections a pair of slots, and such slots can extend substantially radially of the opening.

Each projection can have a substantially triangular shape with an apex close to the center of the opening and a recess in the apex. Each recess is preferably bounded by a substantially concave surface of the respective projection if the protuberance or stud of the support is a cylinder.

The web and the sidewall or sidewalls preferably consist of metallic sheet material, particularly rolled bronze.

At least one panel of each sidewall can be provided with one or more distancing elements which extend toward the other panel of the respective sidewall. Each such distancing element can constitute or include an integral corrugation of the respective panel.

The novel features which are considered as characteristic of the invention are set forth in particular in the appended claims. The improved terminal itself, however, both as to its construction and the mode of making the same, together with additional features and advantages thereof, will be best understood upon perusal of the following detailed description of certain specific embodiments with reference to the accompanying drawing.

DESCRIPTION OF THE PREFERRED EMBODIMENTS

Figures 1, 2, 3, 4:
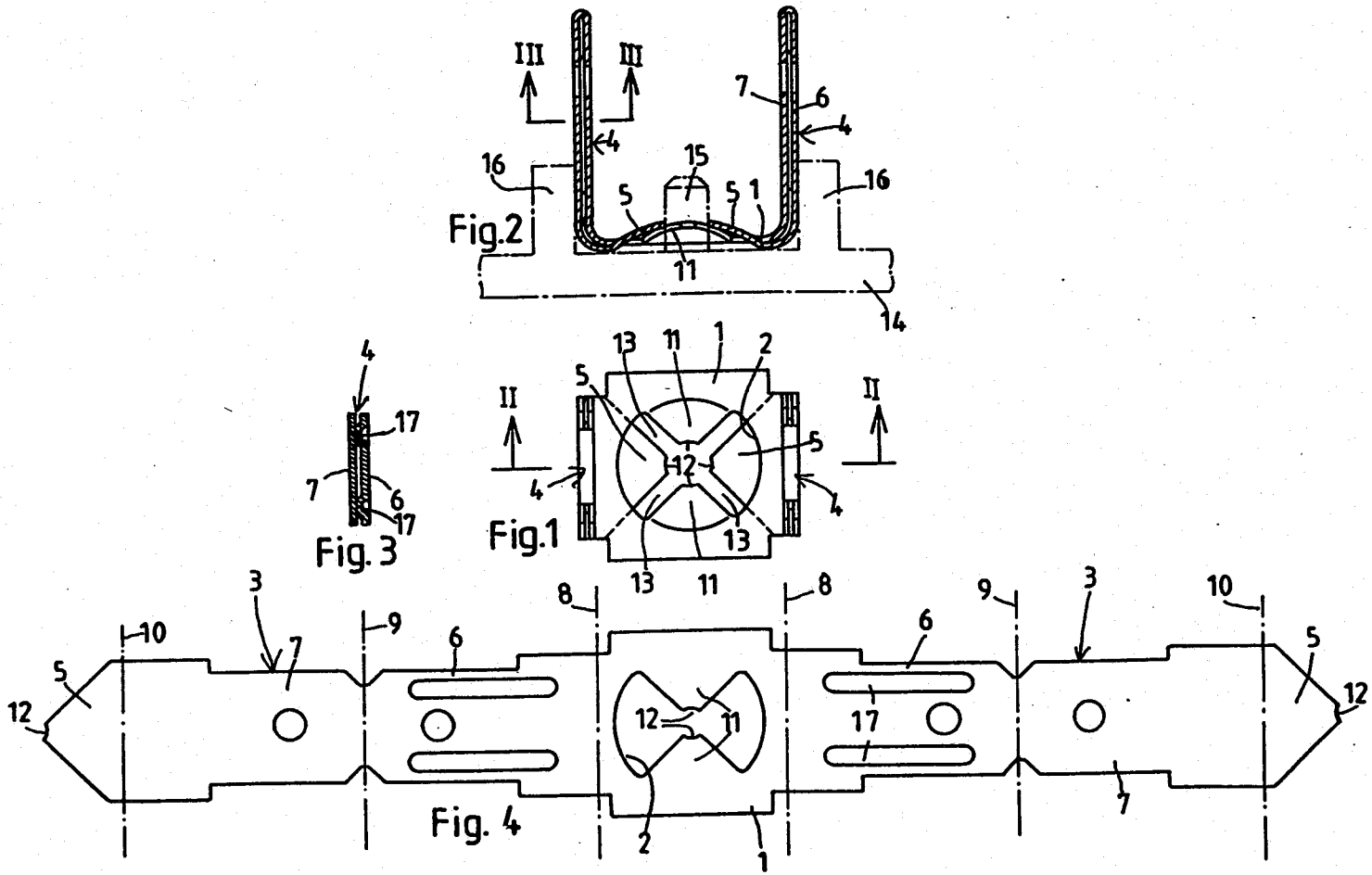
FIG. 1 is a plan view of an electric connecting terminal embodying one form of the present invention.
FIG. 2 is a sectional view of the terminal substantially as seen in the direction of arrows from the line II—II of FIG. 1, a support for the terminal being indicated by phantom lines.
FIG. 3 is a fragmentary sectional view of a sidewall of the terminal as seen in the direction of arrows from the line III—III of FIG. 2.
FIG. 4 is a plan view of a blank which can be converted into the electric contact terminal of FIG. 1.

Referring first to FIGS. 1 to 3, there is shown an electric connecting terminal which is a substantially U-shaped body with a plate-like base or web 1 having a central opening 2 which constitutes a portion of a circular opening, and two projections in the form of sector-shaped lugs 11 extending into but terminating short of the center of the opening 2. The lugs 11 are disposed diametrically opposite each other with reference to the center of the opening 2, and they serve to frictionally engage the peripheral surface of a cylindrical protuberance 15 (hereinafter called stud for short) which forms an integral or separable part of a housing or support including a plate-like member 14 and two spaced-apart locating elements in the form of guide rails 16 which flank the stud 15 and are outwardly adjacent the respective sidewalls 4 of the terminal. Each of the sidewalls 4 forms with the web 1 a substantially L-shaped body, and each of these sidewalls includes an outer panel 6 which is integral with the respective marginal portion of the web 1 and an inner panel 7 which is integral with the respective inner panel 6 as well as with a substantially sector-shaped projection or lug 5. The lugs 5 make right angles with the respective inner panels 7 and overlie portions of the opening 2 in the web 1 so that each of the lugs 5 is flanked by the lugs 11 of the web 1 and the neighboring lugs define radially extending slots 13 to ensure that such neighboring lugs do not interfere with each other in properly engaging and frictionally holding the peripheral surface of the stud 15 when the web 1 is impaled on the stud in a manner as shown in FIG. 2. Each of the lugs 5 and 11 can extend along an arc of approximately 90 degrees in the circumferential direction of the opening 2, and the entire terminal is made of a suitable springy metallic sheet material, such as rolled bronze, so that the lugs 5 and 11 can reliably hold the terminal in a selected position with reference to the support including the parts 14, 15 and 16.

In order to ensure the establishment of a large-area contact between the tips of the lugs 5, 11 on the one hand and the peripheral surface of the stud 15 on the other hand, the apices of such lugs are formed with recesses or notches 12 each of which is bounded by a substantially concave surface with a radius of curvature on or close to the axis of the stud 15. Of course, the configuration of the recesses 12 will be altered if the web 1 is to be impaled on a stud having a polygonal (e.g., square or rectangular) cross-sectional outline.

As can be seen in FIG. 4, the entire terminal is made of a single elongated sheet metal blank including a central portion which constitutes the web 1 of the finished terminal and two wings 3 which extend from the central portion and each of which is provided with parallel weakened fold lines 8, 9, 10 to facilitate conversion of each wing 3 into the respective sidewall 4 and its lug 5. The lugs 5 are bent along the respective fold lines 10 through 90 degrees away from the observer of FIG. 4, the inner panels 7 are bent through 180 degrees with reference to the outer panels 6 along the respective fold lines 9 (toward the observer of FIG. 4), and the panels 6 are bent along the respective fold lines 8 through 90 degrees toward the observer of FIG. 1. This completes the conversion of the blank into a finished terminal whose web 1 is ready to be impaled on the stud 15. The two sets of lugs 5 and 11 practically completely surround the stud 15 when the impaling step is completed.

The rail-shaped members 16 of the support for the terminal are optional; they ensure that the terminal can be mounted and remains in a predetermined orientation. The apices of the lugs 5 and/or 11 can actually penetrate into the material of the stud 15 to even further ensure reliable retention of the terminal in an optimum position. It has been found that the retention of terminal on the stud 15 is sufficiently reliable to render it possible to omit the customary fasteners which are used to locate and hold heretofore known and used fasteners. The lugs 11 and 5 undergo some elastic deformation during impaling of the web 1 on the stud 15, and such deformation requires the application of a relatively small force; however, a much greater force is required to pull the web 1 off the stud 15. This will be readily appreciated by looking at FIG. 2 which shows that the lugs 5 and 12 must be deformed to move beyond the dead-center positions before the web 1 can be pulled off the stud 15.

Each panel 6 has distancing elements in the form of elongated corrugations 17 (see FIGS. 3 and 4) which determine the mutual spacing of the respective panels 6, 7 (i.e., the thickness of the respective sidewalls 4). It is also possible to provide distancing elements on the panels 7 or on each of the panels 6 and 7, depending on the desired rigidity and stability of the sidewalls 4.

An important advantage of the improved terminal is that it can be reliably secured to its support without requiring the application of additional parts, such as bolts, elastic clamps, split rings, screws or otherwise configurated fasteners. This renders it possible to affix the terminal to a selected support within a fraction of the time which is required for attachment of a conventional terminal.

Another important advantage of the improved terminal is that it can be made of a single piece of springy metallic material and that the conversion of the blank which is shown in FIG. 4 into a terminal is a relatively simple and inexpensive operation which can be carried out in available stamping, upsetting and like machines for the making and treatment of sheet metal blanks.

Each of the illustrated lugs 5 and 11 can engage and retain the stud 15 independently of the other lug or lugs, especially if the finished terminal is installed in a manner as shown in FIG. 2, i.e., between two guide rails 16 or similar locating means. At the very least, the lugs 11 can engage and hold the stud 15 independently of the lugs 5 and vice versa. Such lugs can be caused to engage a metallic or plastic stud or the prong of a conventional plug for use in a household or other outlet.

The terminal can be provided with smaller lugs, i.e., with lugs which need not extend along arcs of approximately 90 degrees (as seen in the circumferential direction of the opening 2 in the web 1). The illustrated design is preferred at this time because the relatively large lugs ensure an even more reliable retention of the terminal in a selected position. Uniform distribution of lugs 5 and 11 around the periphery of the stud 15 is desirable because this ensures that each side of the stud is held with the same or with nearly the same force. As mentioned above, the slots 13 ensure that neighboring lugs 5 and 11 cannot interfere with each other during impaling of the web 1 on the stud 15 and that each of the four illustrated lugs can engage the adjacent portion of the peripheral surface of the stud 15 with a large force.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. An electric connecting terminal for impaling on a stud or an analogous protuberance of a support, comprising a web having a stud-receiving opening and two first stud-engaging projections extending into said opening; and two sidewalls integral with said web and having springy second stud-engaging projections overlying a portion of said opening, said web and said sidewalls together forming a substantially L-shaped body and the projections of said sidewalls alternating with said first projections, each of said sidewalls having an outer panel which is integral with said web and an inner panel which is integral with the respective outer panel, said second projections being integral with and extending substantially at right angles to the respective inner panels.

2. The terminal of claim 1, wherein said opening is a substantially circular opening and each of said projections includes a substantially sector-shaped lug extending along an arc of approximately 90 degrees in the circumferential direction of said opening.

3. The terminal of claim 1, wherein each of said second projections defines a pair of slots with said first projections.

4. The terminal of claim 3, wherein said opening is substantially circular and said slots extend substantially radially of said opening.

5. The terminal of claim 1, wherein said web and said sidewalls consist of metallic sheet material.

6. The terminal of claim 5, wherein said material is bronze.

7. The terminal of claim 1, wherein at least one panel of at least one of said sidewalls has at least one distancing element disposed between the respective panels.

8. The terminal of claim 7, wherein said at least one distancing element is an integral corrugation of said at least one panel.

9. An electric connecting terminal for impaling on a stud or an analogous protuberance of a support, comprising a web having a stud-receiving opening and two first stud-engaging projections extending into said opening; and two sidewalls integral with said web and having springy second stud-engaging projections overlying a portion of said opening, said web and said sidewalls together forming a substantially L-shaped body and the projections of said sidewalls alternating with said first projections, each of said projections having a substantially triangular shape with an apex close to the center of said opening and a recess in said apex.

10. The terminal of claim 9, wherein said projections have substantially concave surfaces bounding the respective recesses.

* * * * *